US006026715A

United States Patent [19]

Hu

[11] Patent Number: 6,026,715

[45] Date of Patent: Feb. 22, 2000

[54] HOOK SCREW DRIVERS

[76] Inventor: Bobby Hu, P.O Box 63-247, Taichung, Taiwan

[21] Appl. No.: 09/145,856

[22] Filed: Sep. 2, 1998

[51] Int. Cl.[7] ..... B25B 13/10

[52] U.S. Cl. ..... 81/176.3; 81/111; 81/901

[58] Field of Search ..... 81/99, 111, 176.1, 81/176.3, 177.4, 177.6, 177.7, 901, DIG. 6

[56] References Cited

U.S. PATENT DOCUMENTS

| | | | |
|---|---|---|---|
| 300,317 | 6/1884 | Griffith | 81/901 |
| 855,905 | 6/1907 | Rhoads | 81/901 |
| 4,275,621 | 6/1981 | Mallott, Sr. | 81/111 |

*Primary Examiner*—James G. Smith
*Assistant Examiner*—David B. Thomas
*Attorney, Agent, or Firm*—Charles E. Baxley, Esq.

[57] ABSTRACT

A hook screw driver includes a holding section including a first part and a second part that are releasably engaged together. At least one of the first part and the second part includes an inner side that has a compartment defined therein. A holding member is mounted in the compartment and made of a deformable, frictional material for securely holding a hook portion of a hook screw. One of the first part and the second part has a notch defined in an end thereof and communicated with the compartment. The notch is to be extended by a neck portion of the hook screw.

14 Claims, 6 Drawing Sheets

HOOK SCREW DRIVERS

BACKGROUND OF THE INVENTION

1. Field of the Invention

The present invention relates to hook screw drivers that may be applied to hook screws of various sizes.

2. Description of the Related Art

Hook screws are widely used on wooden walls for hanging objects. The user often use a pair of pliers to clamp a hook screw when mounting the hook screw to a wooden wall which is inconvenient and may cause damage to the hook screw. Although devices have been proposed to securely hold hook screws, yet the holding effect is found unsatisfactory. In addition, the conventional devices cannot be applied to hook screws of various sizes as there are many shapes and sizes in the hook portion of the hook screw. The present invention is intended to provide improved hook screw drivers to solve these problems.

SUMMARY OF THE INVENTION

It is a primary object of the present invention to provide an improved hook screw driver that can be applied to securely hold hook screws of various sizes so as to mount the hook screws to a wooden wall.

A hook screw driver in accordance with the present invention comprises a holding section including a first part and a second part that are releasably engaged together. At least one of the first part and the second part includes an inner side that has a compartment defined therein. A holding member is mounted in the compartment and made of a deformable, frictional material for securely holding a hook portion of a hook screw. Said at least one of the first part and the second part has a notch defined in an end thereof and communicated with the compartment. The notch is to be extended by a neck portion of the hook screw.

In an embodiment of the invention, the holding screw driver further includes an end section that has an end integral with one of the first part and the second part. The other of the first part and the second part is pivotally connected to the end section at an end thereof that is distal to the notch. Each of the first part and the second part includes an outer threading defined in an end thereof that is connected to the end section, and further comprises a retainer ring with inner threading for releasably engagement with the outer threading on the first part and the second part. The outer threading is conic and has a width that gradually increases from an end adjacent to the end section to an end distal to the end section.

The end section may further include a stop means formed on an outer surface thereof to keep the retainer ring between the stop means and the outer threading of the holding section. The stop means may be a resilient member having a distal end projecting toward the holding section.

The holding member may include a retaining section formed thereon, the retaining section having a pattern constructed by a plurality of spaced second blocks that constitute a plurality of grooves.

In a preferred embodiment of the invention, a hook screw driver comprises an end section and a holding section including a first part and a second part having inner sides that face each other. The first part has a first end with a first compartment defined in the inner side thereof and a second end securely connected to the end section. The second part has a first end with a second compartment defined in the inner side thereof and aligned with the first compartment and a second end pivotally connected to the end section Each of the first part and the second part includes a holding member mounted therein, the holding member being made of a deformable, frictional material for securely holding a hook portion of a hook screw. At least one of the first ends of the first part and the second part has a notch defined in an end thereof and communicated with one of the first compartment and the second compartment. The notch is to be extended by a neck portion of the hook screw.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
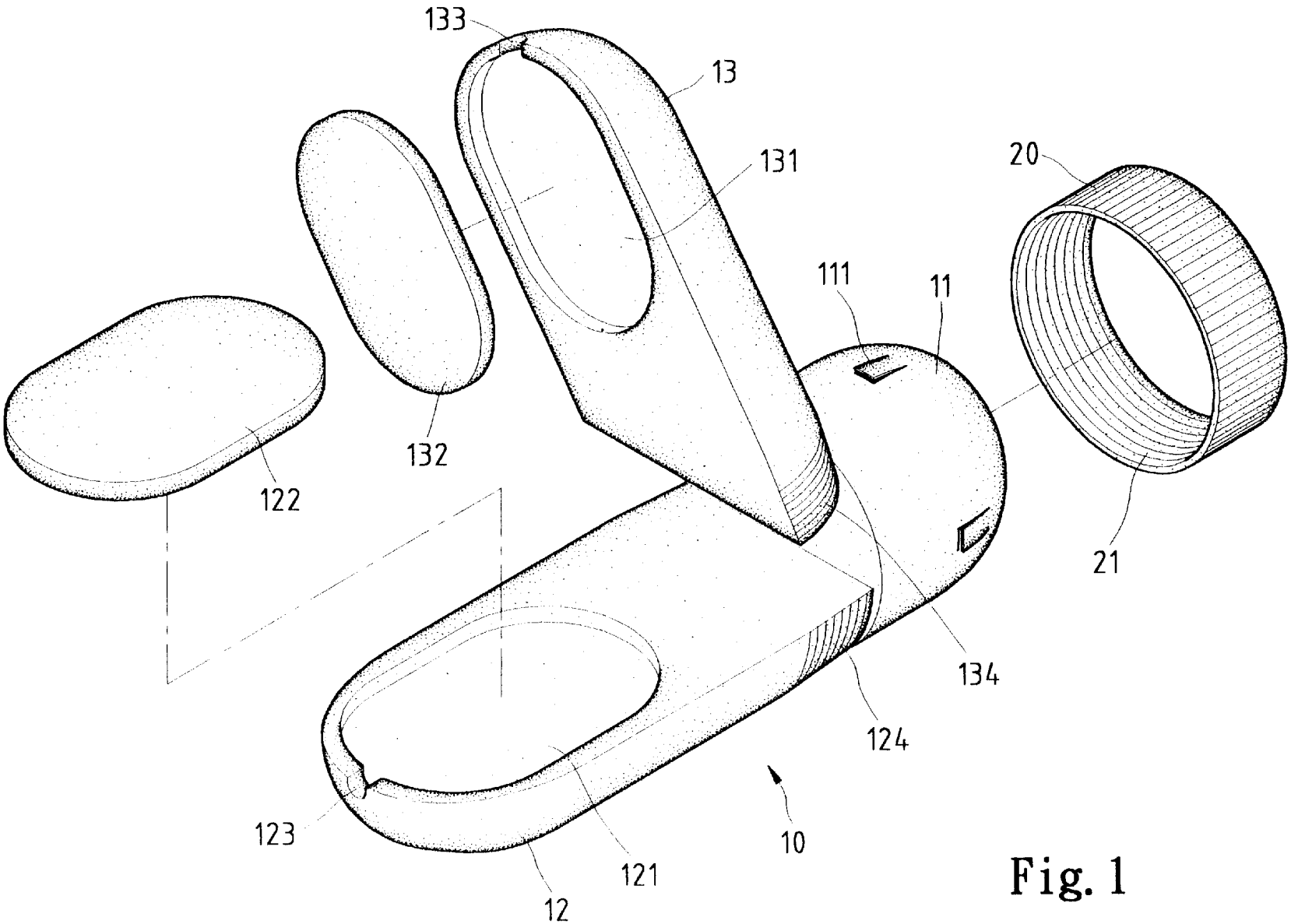
FIG. 1 is an exploded perspective view of a first embodiment of a hook screw driver in accordance with the present invention.
Figure 2:
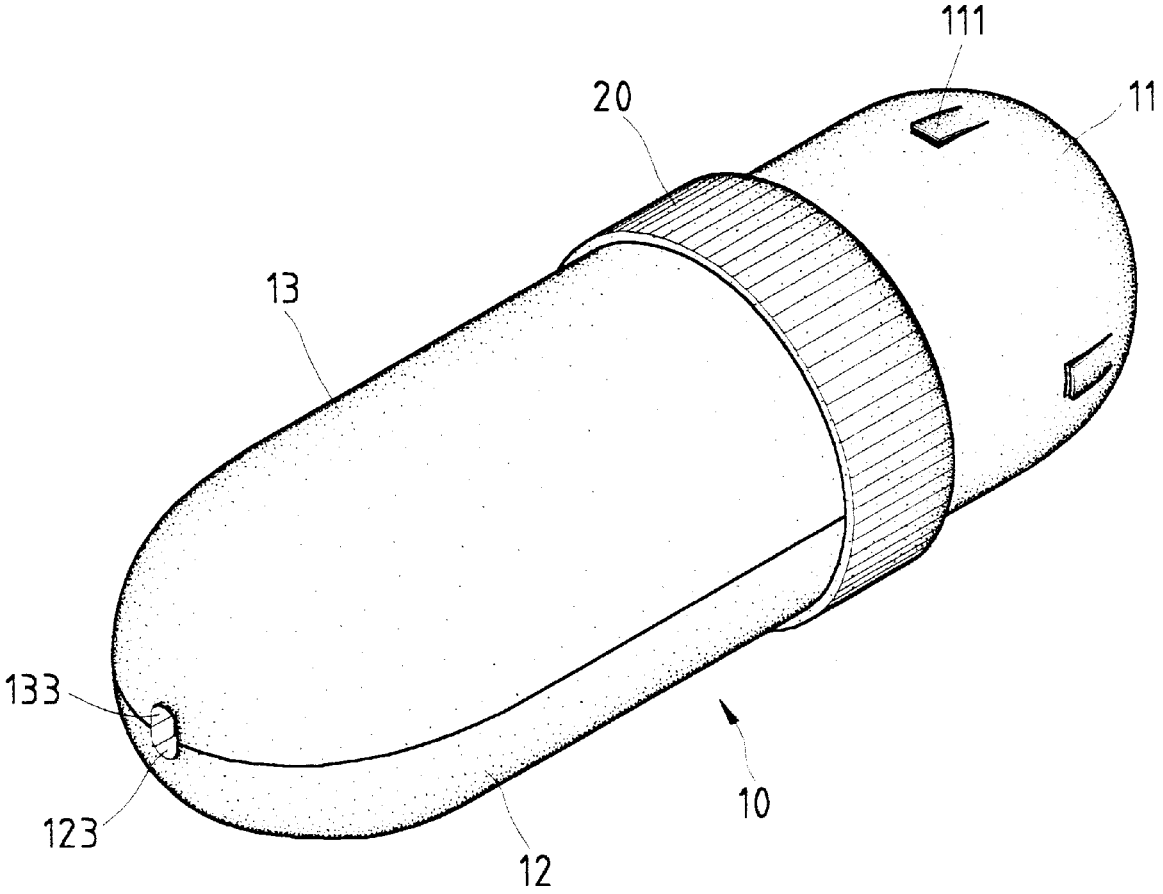
FIG. 2 is a perspective view of the hook screw driver.
Figure 3:
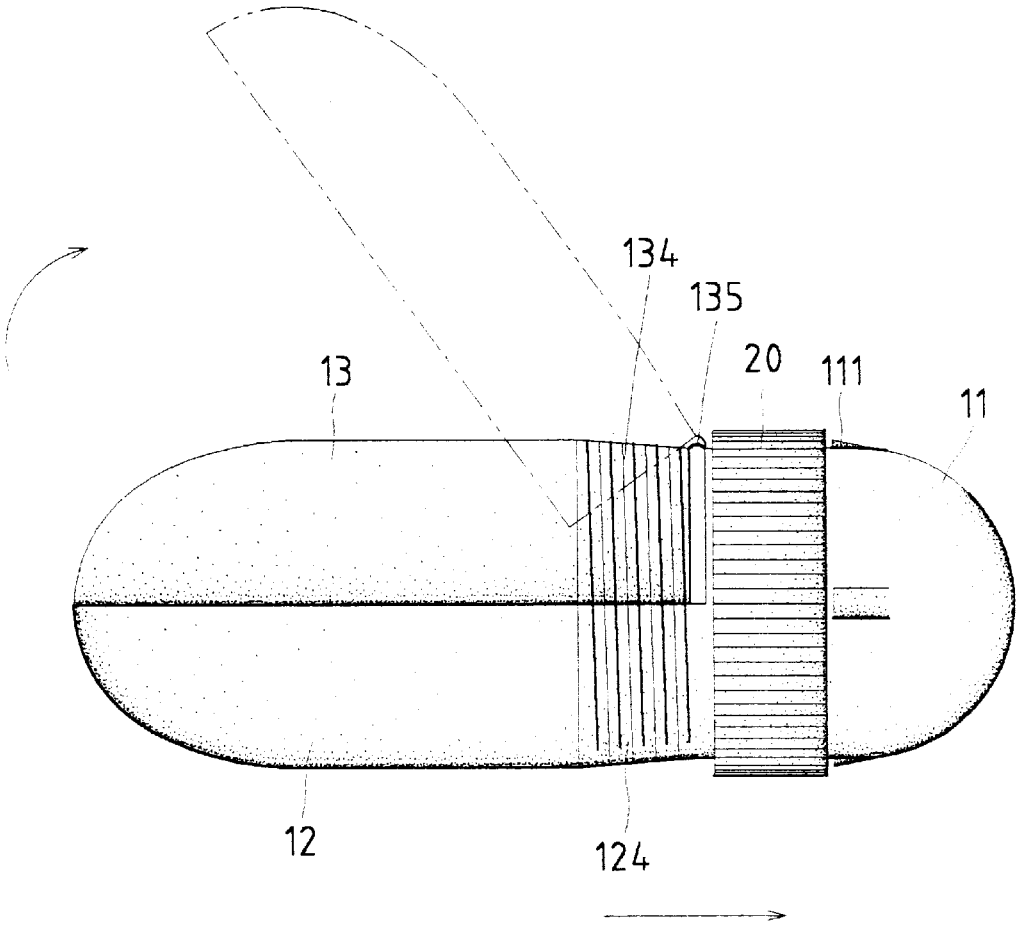
FIG. 3 is a side view illustrating opening and closing of the hook screw driver.

Referring to the drawings and initially to FIGS. 1 and 2, a hook screw driver in accordance with the present invention generally includes a holding section 10 and an end section 11. The holding portion 10 includes a first part 12 integral with the end section 11 and a second part 13. Each part 12, 13 includes an inner side that includes a compartment 121, 131 defined in a first end thereof The first end of each part 12, 13 includes a notch 123, 133 defined therein and communicated with the compartment 121, 131. A soft holding member 122, 132 is received in the compartment 121, 131 and preferably made of a highly deformbale, high frictional material for securely holding a hook portion 101 (FIG. 4) of a hook screw 100, which will be described later. In addition, a second end of each part 12, 13 includes a threading 124, 134 defined in an outer side thereof The threading 124, 134 may be arranged in a conic manner (FIG. 3). Namely, the width of the conic threading 124, 134 increases gradually from the second end to the first end of the associated part 12, 13. This may increase the holding effect of the hook screw 100.

The end section 11 includes an end that is preferably integral with the second end of the first part 12. The end section 11 may include at least one resilient stop member 111 (four resilient stop members 111 in this embodiment) that has a distal end projecting outwardly toward the holding section 10. A retainer ring 20 with an inner threading 21 is passable through the resilient stop members 111, which will be described later.

In assembly, the hook portion 101 of the hook screw 100 is placed onto the soft holding member (e.g., member 122) received in the compartment 121 of the first part 12. Then, the second part 131 is engaged with the first part 13 such that the soft holding members 122 and 132 together hold the hook portion 101 of the hook screw 100, best shown in FIG.

Figure 4:
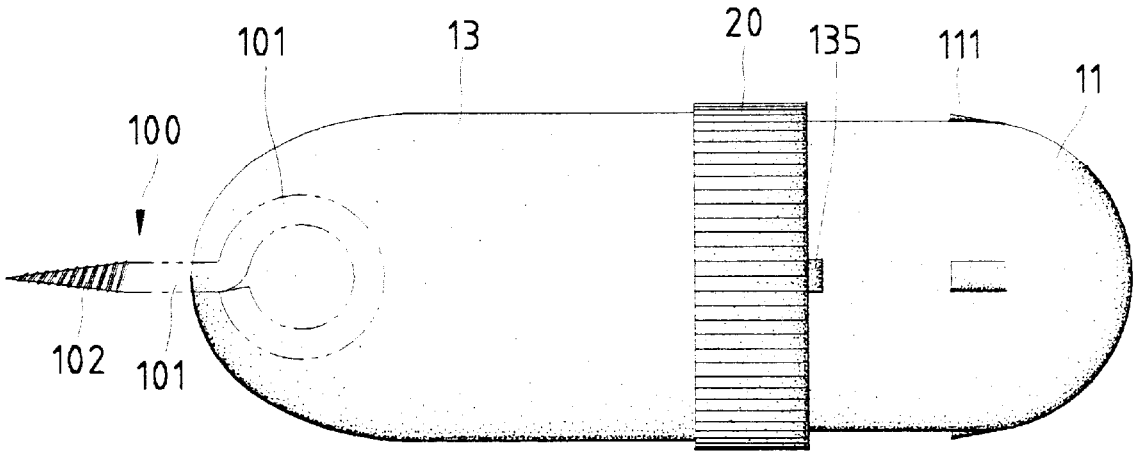
FIG. 4 is a top view of the hook screw driver in use.
Figure 5:
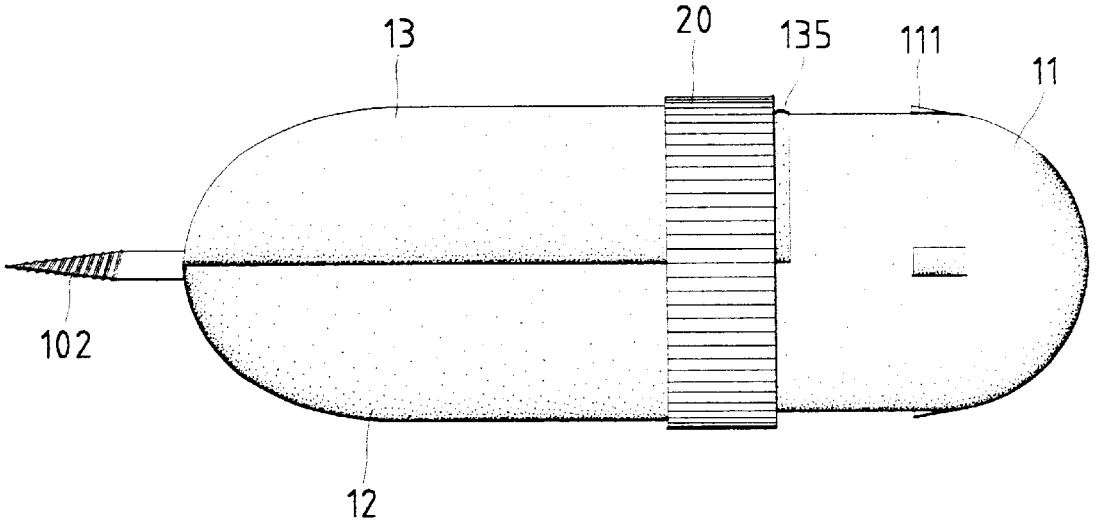
FIG. 5 is a side view of the hook screw driver in FIG. 4.
Figure 6:
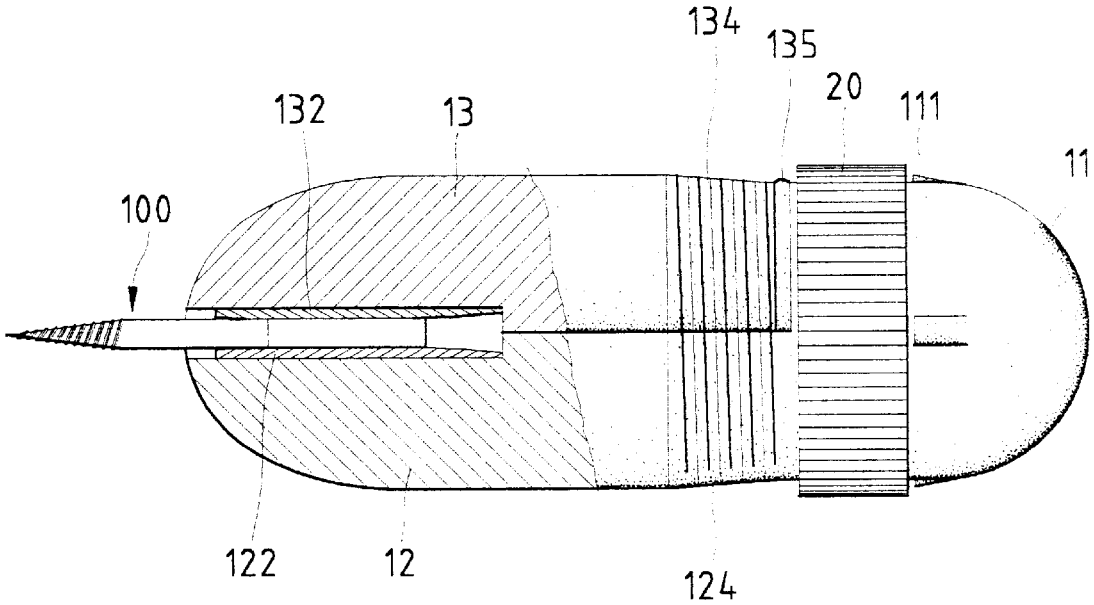
FIG. 6 is a partly sectioned side view illustrating use of the hook screw driver.

6. The retainer ring 20 is moved to threadedly engage with the threading 124 and 134 of the first part 12 and the second part 13, respectively, as shown in FIGS. 4 and 5. Thus, the hook portion 101 of the hook screw 100 is securely held by the hook screw driver of the present invention. Inadvertent loss of the retainer ring 20 is prevented by provision of the resilient members 111. The neck (not labeled) of the hook screw 100 is extended through the notches 123 and 133 of the first part 12 and the second part 13, respectively. In addition, as shown in FIG. 3, the second part 13 may include a pivotal section 135 formed on the second end thereof The pivotal section 135 is connected to the end section 11 to allow pivotal movement of the second part 13 relative to the end section 11 and the first part 12. This may prevent inadvertent loss of the second part 13, improve holding effect of the hook screw 100, and allow easy reception of the hook screw 100.

In use, the user may hold the hook screw driver and apply a rotational force to the hook screw driver so as to threadedly inserting a hook end 102 (FIG. 5) of the hook screw into a wooden wall (not shown). It is appreciated that the soft holding members 122 and 132 may effectively retain the hook portion 101 of the hook screw 100 as the soft holding members 122 and 132 are made of a highly deformable, high friction material. After completion of mounting of the hook screw onto the wooden wall, the retainer ring 20 is disengaged from the threading 124, 134, and the user may open the second part 13 (see the phantom lines in FIG. 3) to allow disengagement of the hook screw 100 from the hook screw driver.

Figure 8:
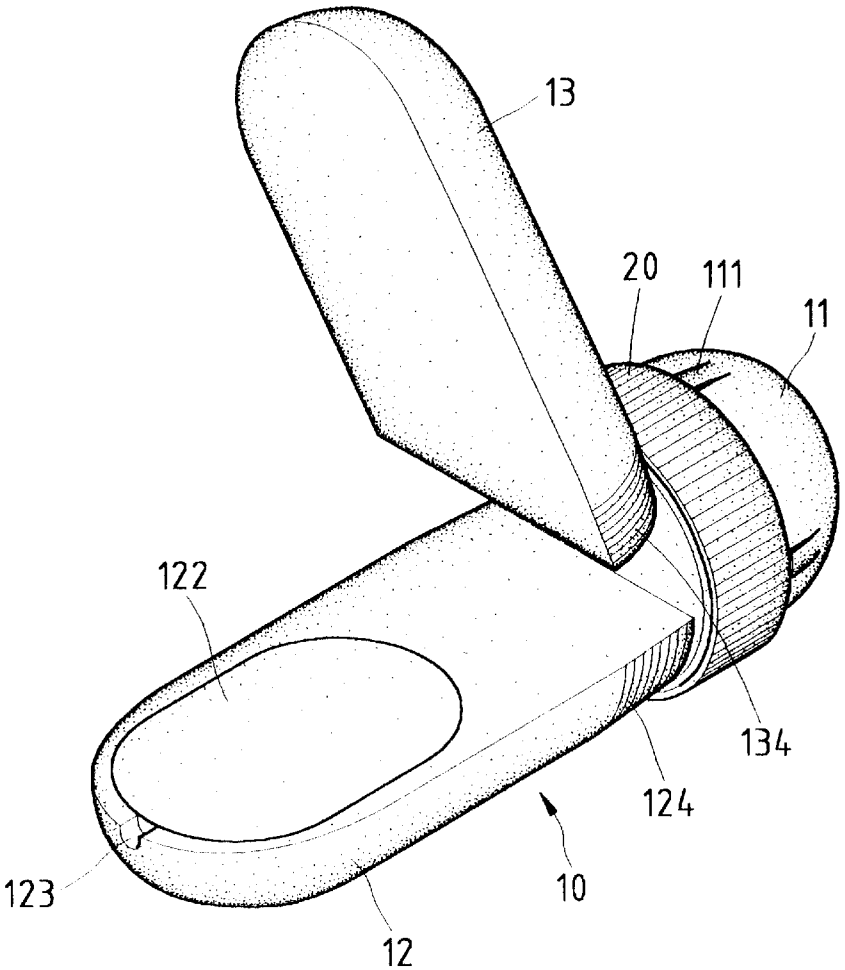
FIGS. 7 and 8 are perspective views of modified embodiments of the hook screw driver in FIG. 1.
Figure 7:
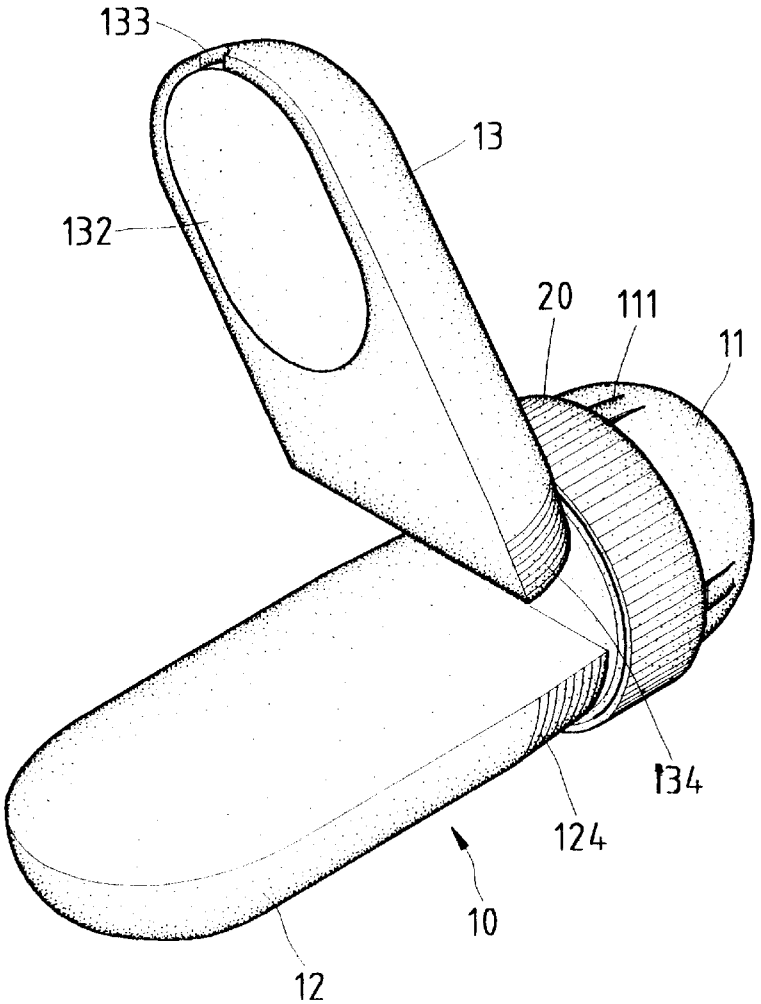

FIG. 7 illustrates a modified embodiment of the hook screw driver of the invention, in which the compartment 121, the holding member 122, and the notch 123 of the first part 12 are omitted. FIG. 8 illustrates another modified embodiment of the hook screw driver of the invention, in which the compartment 131, the holding member 132, and the notch 133 of the second part 13 are omitted.

Figure 9:
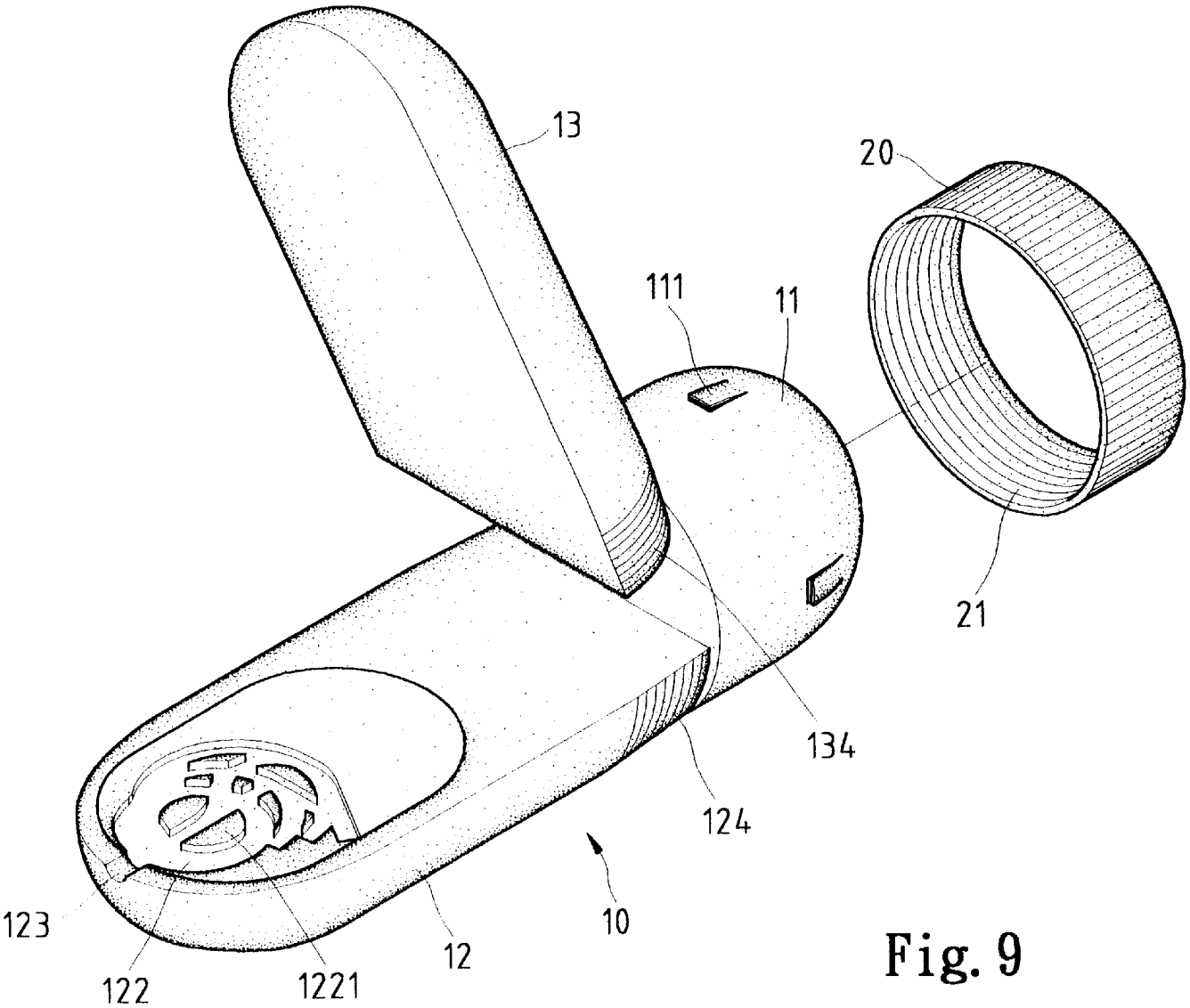
FIG. 9 is a further modified embodiment of the hook screw driver.

FIG. 9 illustrates a further modified embodiment of the hook screw driver of the invention, in which the holding member 122 includes a retaining section (not labeled) that has a pattern formed thereon The pattern is constructed by a plurality of spaced blocks 1221 that constitute a plurality of grooves adapted to securely retain the hook portion 101 of the hook screw 100 the size of which may vary in a wide range. In addition, as the soft holding member 122 is made of a material that is highly deformable, even though combinations of the grooves do not include the exact configuration of the hook portion 101 of the hook screw 100, the holding member 122 can be slightly deformed to fittingly receive the hook portion 101.

According to the above description, it is appreciated that the hook screw driver may be applied to the hook screws of numerous sizes and the operation thereof is simple.

Although the invention has been explained in relation to its preferred embodiment, it is to be understood that many other possible modifications and variations can be made without departing from the spirit and scope of the invention as hereinafter claimed.

What is claimed is:

1. A hook screw driver, comprising a holding section including a first part and a second part that are releasably engaged together, at least one of the first part and the second part including an inner side that has a compartment defined therein, a holding member being mounted in the compartment and made of a deformable, frictional material for securely holding a hook portion of a hook screw, said at least one of the first part and the second part having a notch defined in an end thereof and communicated with the compartment, said notch being adapted to be extended by a neck portion of the hook screw.

2. The hook screw driver according to claim 1, wherein the holding screw driver further includes an end section that has an end integral with one of the first part and the second part.

3. The hook screw driver according to claim 2, wherein the other of the first part and the second part is pivotally connected to the end section at an end thereof that is distal to the notch.

4. The hook screw driver according to claim 2, wherein each of the first part and the second part includes an outer threading defined in an end thereof that is connected to the end section, and further comprises a retainer ring with inner threading for releasably engagement with the outer threading on the first part and the second part.

5. The hook screw driver according to claim 4, wherein the outer threading is conic and has a width that gradually increases from an end adjacent to the end section to an end distal to the end section.

6. The hook screw driver according to claim 4, wherein the end section further includes a stop means formed on an outer surface thereof to keep the retainer ring between the stop means and the outer threading of the holding section.

7. The hook screw driver according to claim 6, wherein the stop means is a resilient member having a distal end projecting toward the holding section.

8. The hook screw driver according to claim 1, wherein the holding member includes a retaining section formed thereon, the retaining section having a pattern constructed by a plurality of spaced second blocks that constitute a plurality of grooves.

9. A hook screw driver, comprising an end section and a holding section including a first part and a second part having inner sides that face each other, the first part having a first end with a first compartment defined in the inner side thereof and a second end securely connected to the end section, the second part having a first end with a second compartment defined in the inner side thereof and aligned with the first compartment and a second end pivotally connected to the end section, each of the first part and the second part including a holding member mounted therein, the holding member being made of a deformable, frictional material for securely holding a hook portion of a hook screw, at least one of the first ends of the first part and the second part having a notch defined in an end thereof and communicated with one of the first compartment and the second compartment, said notch being adapted to be extended by a neck portion of the hook screw.

10. The hook screw driver according to claim 9, wherein each of the first part and the second part includes an outer threading defined in the second thereof, and further comprises a retainer ring with inner threading for releasably engagement with the outer threading on the first part and the second part.

11. The hook screw driver according to claim 10, wherein the outer threading is conic and has a width that gradually increases from an end adjacent to the end section to an end distal to the end section.

12. The hook screw driver according to claim 10, wherein the end section further includes a stop means formed on an outer surface thereof to keep the retainer ring between the stop means and the outer holding section.

13. The hook screw driver according to claim 12, wherein the stop means is a resilient member having a distal end projecting toward the holding section.

14. The hook screw driver according to claim 9, wherein the holding member includes a retaining section formed thereon, the retaining section having a pattern constructed by a plurality of spaced second blocks that constitute a plurality of grooves.

* * * * *